US005193616A

United States Patent [19]

Hynes

[11] Patent Number: 5,193,616

[45] Date of Patent: Mar. 16, 1993

[54] TUBING HANGER SEAL ASSEMBLY

[75] Inventor: Joseph H. Hynes, Houston, Tex.

[73] Assignee: Cooper Industries, Inc., Houston, Tex.

[21] Appl. No.: 740,801

[22] Filed: Aug. 6, 1991

[51] Int. Cl.[5] ..... E21B 33/04

[52] U.S. Cl. ..... 166/208; 166/382; 277/236

[58] Field of Search ..... 166/208, 382, 387, 206; 277/116.2, 117, 236

[56] References Cited

U.S. PATENT DOCUMENTS

| | | | |
|---|---|---|---|
| 3,273,646 | 9/1966 | Walker | 166/86 |
| 3,404,736 | 10/1968 | Nelson et al. | 166/85 |
| 3,797,864 | 3/1974 | Hynes et al. | 285/140 |
| 4,131,287 | 12/1978 | Gunderson et al. | 277/191 |
| 4,496,162 | 1/1985 | McEver et al. | 277/9.5 |
| 4,521,040 | 6/1985 | Slyker et al. | 285/140 |
| 4,572,515 | 2/1986 | Grazioli | 277/12 |
| 4,588,030 | 5/1986 | Blizzard | 166/120 |
| 4,615,544 | 10/1986 | Baugh | 285/18 |
| 4,665,979 | 5/1987 | Boehm, Jr. | 166/208 |
| 4,742,874 | 5/1988 | Guillion | 166/348 |
| 4,747,606 | 5/1988 | Jennings | 277/182 |
| 4,749,047 | 6/1988 | Taylor | 166/382 |
| 4,771,828 | 9/1988 | Cassity | 166/115 |
| 4,771,832 | 9/1988 | Bridges | 166/380 |
| 4,790,572 | 12/1988 | Slyker | 285/140 |
| 4,815,770 | 3/1989 | Hyne et al. | 285/140 |
| 4,823,871 | 4/1989 | McEver et al. | 166/182 |
| 4,832,125 | 5/1989 | Taylor | 166/348 |
| 4,842,061 | 6/1989 | Nobileau | 166/208 X |
| 4,911,245 | 3/1990 | Adamek et al. | 166/387 |
| 5,038,865 | 8/1991 | Taylor et al. | 166/208 X |

*Primary Examiner*—Terry Lee Melius
*Attorney, Agent, or Firm*—David A. Rose

[57] ABSTRACT

A tubing hanger assembly having a metal-to-metal seal assembly for sealing the annulus between the tubing hanger assembly and an outer casing hanger assembly. The metal-to-metal seal assembly includes a static metal-to-metal seal for sealing with the tubing hanger assembly and a dynamic metal-to-metal seal for sealing with the casing hanger assembly. The static metal-to-metal seal sealingly engages the body of the tubing hanger assembly as a part of the factory assembly procedure. Thus, the static metal-to-metal seal may be tested at the factory and replaced if leakage is detected. The dynamic metal-to-metal seal has a non-sealing position when run into the well and a sealing position upon actuation downhole. The metal-to-metal seal assembly includes actuation means engageable with the outer casing assembly that actuates the dynamic metal-to-metal seal from the non-sealing position to the sealing position.

15 Claims, 5 Drawing Sheets

TUBING HANGER SEAL ASSEMBLY

BACKGROUND OF THE INVENTION

This invention relates to seals for sealing the annulus between a tubing hanger assembly and a casing hanger assembly and more particularly to a nose seal on the lower end of the tubing hanger assembly for sealingly engaging the previously run casing hanger assembly.

The subsea exploration and production of oil and gas reserves includes suspending from a wellhead housing a plurality of concentric strings of casing and tubing within the bore of the well. A series of casing hangers, each suspending a casing string, are stacked and supported within the wellhead housing. In the installation of successive casing strings within the well, a casing hanger assembly suspending a casing string is lowered through the bop stack for suspension within the wellhead housing. After the successive strings of casing are installed and cemented into the well, a tubing hanger assembly suspending one or more strings of tubing is lowered into the wellhead housing and suspended within the last installed casing hanger assembly.

Tubing hanger assemblies designed for subsea wellheads require that a seal be established between the last casing string and the tubing string. This seal seals the annulus between the casing and tubing strings and is often located near the lower end of the tubing hanger assembly for sealing with the previously run casing hanger assembly. This type of seal is referred to as a nose seal.

Tubing hanger assemblies may also include a seal located near the upper end of the tubing hanger assembly for sealing with the internal diameter of the wellhead housing. This seal assembly is either identical to or substantially the same as the seal assemblies used to seal the annulus between previously run casing hanger assemblies.

Some prior art tubing hanger assemblies include both a nose seal for sealing between the tubing hanger assembly and previously run casing hanger assembly as well as an upper seal for sealing between the tubing hanger assembly and the wellhead housing. Such prior art tubing hanger assemblies thus have both a nose seal and a regular casing hanger seal assembly.

In the above prior art sealing arrangements, the great majority of the seals are resilient seals and the remainder are combination metal and elastomer seals. In either case, the seal between the seal assembly and the tubing hanger body and the seal between the seal assembly and the casing hanger and/or wellhead housing are both made downhole.

The present invention overcomes the deficiencies of these prior art tubing hanger seals.

SUMMARY OF THE INVENTION

The present invention includes a tubing hanger assembly having a metal-to-metal seal assembly for sealing the annulus between the tubing hanger assembly and an outer casing hanger assembly. The metal-to-metal seal assembly includes a static metal-to-metal seal for sealing with the tubing hanger assembly and a dynamic metal-to-metal seal for sealing with the casing hanger assembly. The static metal-to-metal seal is sealingly engaged with the body of the tubing hanger assembly as a part of the factory assembly procedure. Further the static metal-to-metal seal is tested at the factory and is replaceable. In the event the static metal-to-metal seal is damaged in transit or damaged by handling, it can be replaced and retested before the tubing hanger assembly is run into the well.

The dynamic metal-to-metal seal has a non-sealing position when it is run into the well and a sealing position which is established downhole. The metal-to-metal seal assembly includes actuation means engageable with the outer casing hanger assembly which actuates the dynamic metal-to-metal seal from the non-sealing position to the sealing position.

One of the objects of the present invention is that the metal-to-metal seals of the tubing hanger assembly are replaceable.

Another object of the present invention is that the replaceable metal-to-metal seals of the present invention are constructed in such a manner that the static metal-to-metal seal with the tubing hanger body is effected by the assembly of the seal assembly on the tubing hanger body.

A further objective of the present invention is that the tubing hanger body is constructed such that a metal-to-metal seal is effected with the static metal-to-metal seal upon the seal assembly being assembled with the tubing hanger body.

In a still further object of the present invention, the replaceable metal-to-metal seals include a static metal-to-metal seal having two or more spaced apart sealing ridges contacting the tubing hanger body.

Another objective of the present invention is a tubing hanger body constructed such that multiple metal-to-metal seals are effected with the spaced apart sealing ridges with the seal assembly as a function of being assembled.

A still further object of the present invention is the provision of a test port that enables the testing of the static metal-to-metal seal before the tubing hanger assembly is run into the wellbore.

Other objects and advantages of the invention will appear from the following description.

BRIEF DESCRIPTION OF THE DRAWINGS

For a detailed description of the preferred embodiment of the invention, reference will now be made to the accompanying drawings wherein.

DESCRIPTION OF THE PREFERRED EMBODIMENT

Figure 1:
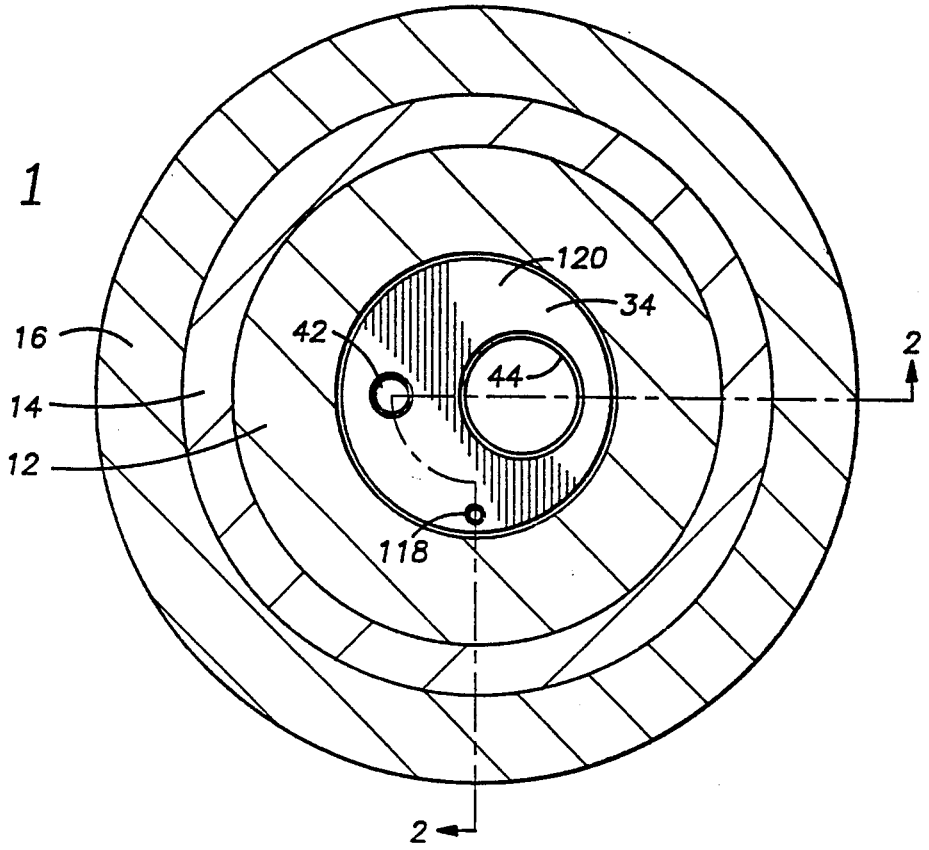
FIG. 1 is a view of the lower end of the tubing hanger assembly with the metal-to-metal seal assembly of the present invention.
Figure 2:
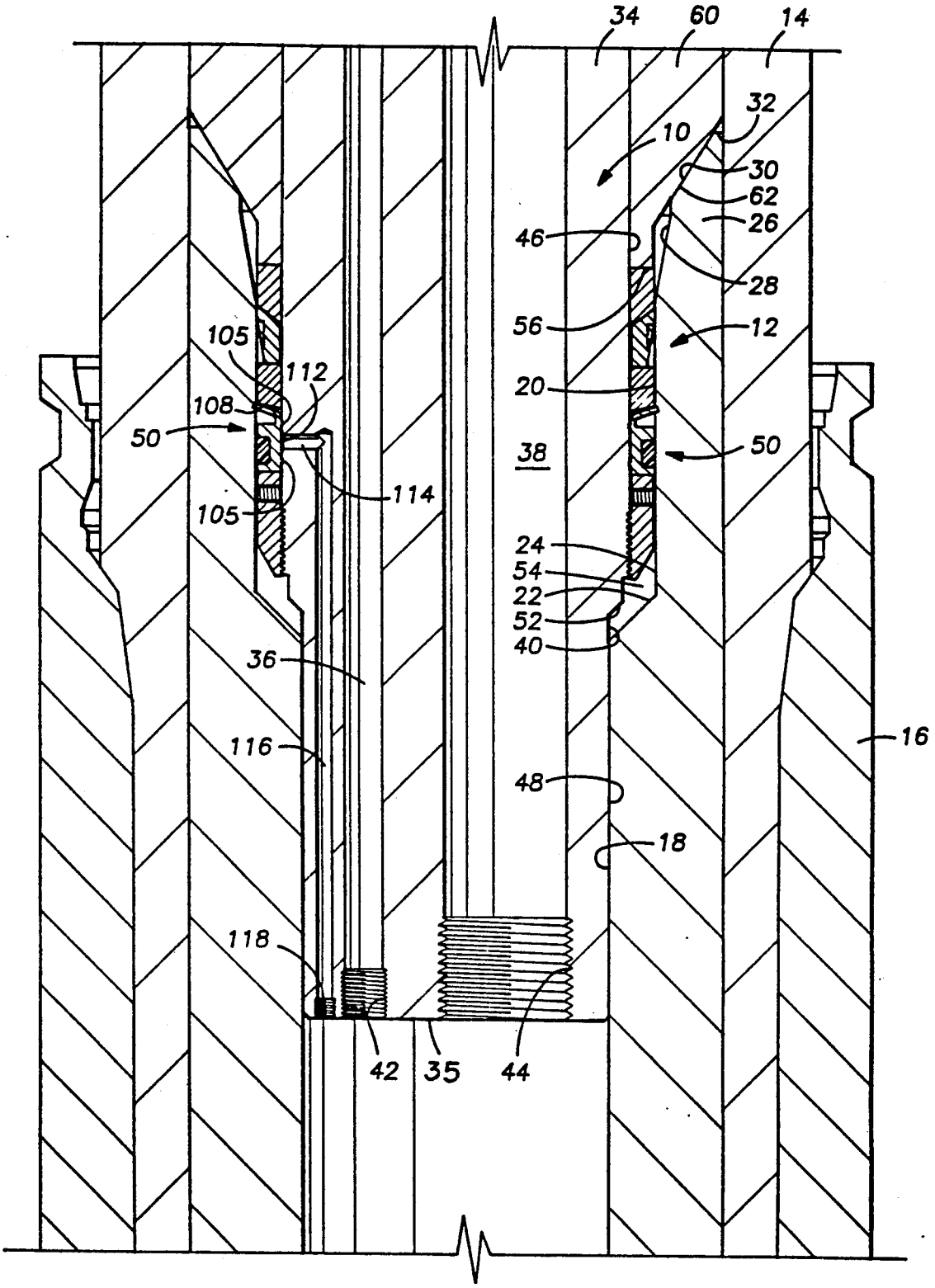
FIG. 2 is a cross-sectional view of the tubing hanger assembly taken at plane 2—2 of FIG. 1.

Referring initially to FIGS. 1 and 2, there is shown a tubing hanger assembly 10 supported within the previously run or last installed casing hanger assembly 12. The last installed casing hanger assembly 12 either may be supported directly by wellhead housing 14 or by one or more previously installed casing hanger assemblies which in turn are supported within the wellhead housing 14. Wellhead housing 14 is supported within conductor casing 16. Casing hanger assembly 12 includes an internal profile 18 for receiving and supporting tubing hanger assembly 10. Internal profile 18 includes an enlarged bore 20 forming a lower upwardly facing frusto-conical shoulder 22 and an upwardly extending annular wall 24. The diameter of bore 20 is further enlarged adjacent its upper end 26 to form an upwardly facing, upwardly and outwardly tapering frusto-conical camming shoulder 28. An upwardly facing frusto-conical landing shoulder 30 is also formed at the upper terminal end 32 of casing hanger assembly 12.

Tubing hanger assembly 10 includes a tubing hanger body 34 with one or more through bores 36, 38 having threaded lower box ends 42, 44, respectively, for threading engagement with one or more tubing strings (not shown) to be suspended within the well. The tubing hanger assembly 10 also includes various other means for landing and locking the tubing hanger assembly 10 within the casing hanger assembly 12 or wellhead housing 14. Such means together with other complimentary assemblies are included on the Cameron hydraulic tubing hanger assembly sold for the Shell Osprey Project and illustrated on drawing SK-53174-01 dated May 9, 1989, incorporated herein by reference. Since such means are well known to one skilled in the art, and since such means are not required for a description of the metal-to-metal seal assembly of the present invention, no further description shall be made of that portion of the tubing hanger assembly 10.

Tubing hanger body 34 has an external profile 40 adapted to be received within the internal profile 18 of last installed casing hanger assembly 12. The tubing hanger body profile 40 includes an upwardly extending outer annular wall 46 and a lower reduced diameter annular wall 48. A downwardly facing frusto-conical shoulder 52 is formed due to the change in diameters between walls 46 and 48. The difference in diameters of outer annular wall 46 of tubing hanger assembly 10 and the diameter of enlarged bore 20 of casing hanger assembly 12 forms an annular space 54 having a predetermined clearance therebetween which is defined by the difference of such diameters.

Figure 3:
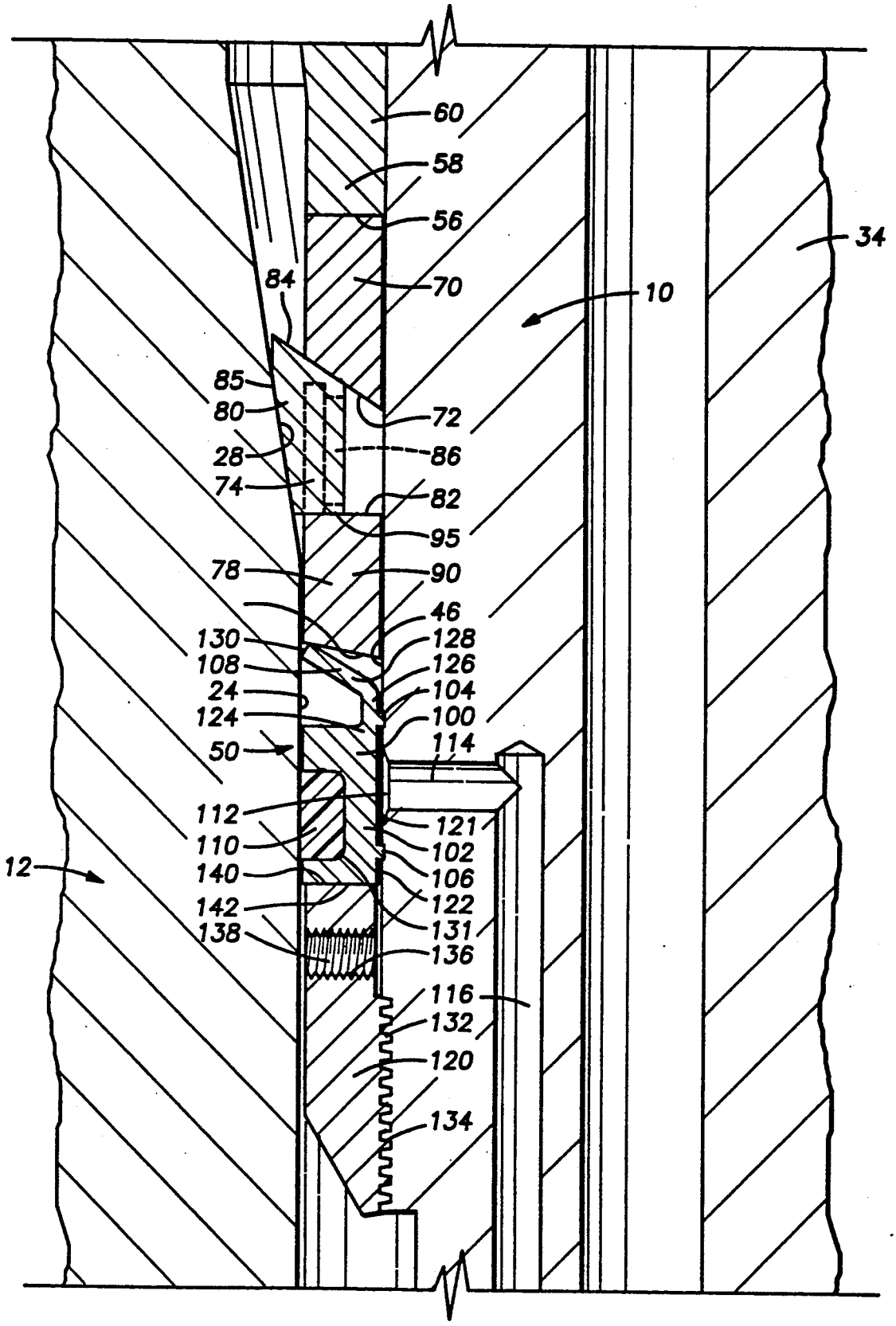
FIG. 3 is an enlarged cross-sectional view of the metal-to-metal seal assembly of FIG. 2 in a non-actuated position.
Figure 4:
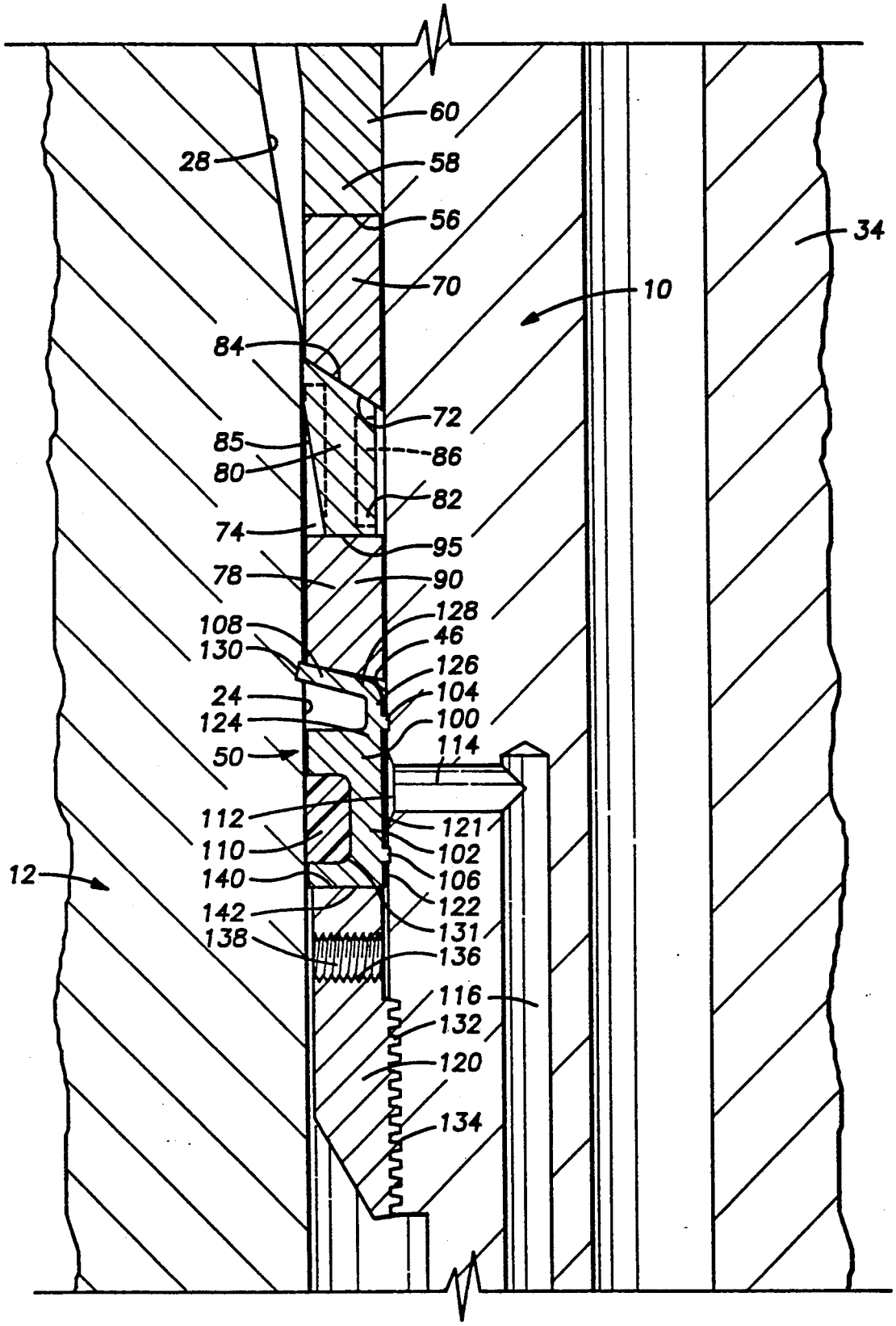
FIG. 4 is an enlarged cross-sectional view of the metal-to-metal seal assembly in FIG. 3 in the actuated position.

As shown in FIGS. 2–4, a tubing hanger seal assembly 50 of the present invention is disposed around upwardly extending outer annular wall 46 of tubing hanger body 34 and in particular is disposed in the annular space 54 between tubing hanger assembly 10 and casing hanger assembly 12 in the installed position shown in FIG. 2.

The tubing hanger seal assembly 50 abuts, at its upper end, against a downwardly facing annular shoulder 56. Although there are various means of providing this downwardly facing annular shoulder, annular shoulder 56 of the preferred embodiment is formed by the lower terminal end 58 of a load/landing ring 60. Load/landing ring 60 is also disposed on outer annular wall 46 above tubing hanger seal assembly 50. Since shoulder 56 acts as an upper stop for the tubing hanger seal assembly 50, it is important that annular shoulder 56 and therefore load/landing ring 60, be affixed to tubing hanger body 34 so as to maintain the fixed location of shoulder 56 with respect to seal assembly 50. Load/landing ring 60 also includes a downwardly facing and upwardly tapering frusto-conical shoulder 62 which lands and is supported by upwardly facing annular landing shoulder 30 on outer casing hanger assembly 12.

Referring now particularly to FIG. 3, there is shown an enlarged view of the nose seal or tubing hanger seal assembly 50 of the present invention in the non-actuated position. Tubing hanger seal assembly 50 includes a plurality of annular members which are slidingly received over the lower end of annular wall 46 of tubing hanger body 34 and disposed below downwardly facing annular shoulder 56 and above downwardly facing annular shoulder 52. Tubing hanger seal assembly 50 includes an upper spacer ring 70, a plurality of wedge segments 80, a lower spacing ring 90, metal-to-metal seal ring 100, an elastomeric secondary seal 110 and a seal retainer ring 120.

Metal-to-metal seal ring 100 includes an annular body 102 in the form of a metal ring which circumscribes annular wall 46 of tubing hanger assembly 10. The thickness of body 102 approximates the clearance of annular space 54. Metal-to-metal seal ring 100 includes a static metal-to-metal seal 105 for sealing with the surface of annular wall 46 of tubing hanger assembly 10 and a dynamic metal-to-metal seal 108 for sealing with the surface of annular wall 24 of outer casing hanger assembly 12. Static metal-to-metal seal 105 includes at least one and preferably two inwardly directed annular metal ridges 104, 106 for coining into the surface of wall 46. Ridges 104, 106 have an inner diameter less than the outer diameter of wall 46 such that upon installation, annular ridges 104, 106 interferingly fit onto the surface of wall 46 for metal-to-metal sealing engagement therewith.

Annular sealing ridges 104, 106 are spaced apart on the inner annular surface 121 of annular body 102 so as to bracket a hydraulic test port 112. As shown, upper sealing ridge 104 is located above port 112 and annular sealing ridge 106 is located below test port 112. Test port 112 communicates with horizontal bore 114 which in turn communicates with a longitudinal bore 116 that extends to a fixture 118 at the lower terminal end 35 of tubing hanger body 34. As can be appreciated, a hydraulic line (not shown) may be connected to fixture 118 for applying hydraulic pressure through test port 112, via bores 114, 116, to test the integrity of the metal-to-metal seals formed by ridges 104, 106 with annular wall 46 of tubing hanger body 34. Although annular ridges 104, 106 are shown coined into wall 46, a very small clearance 122 is provided between the inner annular surface 121 of annular body 102 and the outer surface of wall 46 for installation purposes. The clearance 122 between ridges 104, 106 forms an inner annular groove.

A metal-to-metal seal assembly having a static metal-to-metal seal is not possible on a casing hanger assembly because of the requirement that cement returns pass back up through the annulus, past the casing hanger assembly, and back to the surface. The casing hanger seals are run into the wellbore on either the casing hanger running tool or the casing hanger assembly, but always in an unset position and moved into a sealing position after the casing cementing operations have been completed.

Dynamic metal-to-metal seal 108 is an integral extension of the upper inner annular corner 124 of annular body 102. The annular extension of dynamic metal-to-metal seal 108 includes a lower cylindrical portion 126 and an upper frusto-conical portion 128 terminating in a sealing lip 130 Dynamic metal-to-metal seal 108 is deformable between the undeflected position shown in FIG. 3 where no sealing contact is made, to the deflected position shown in FIG. 4 where upper frusto-conical portion 128 has been deformed so that annular sealing lip 130 coins into the sealing surface of annular wall 24 of casing hanger assembly 12. The deformation of dynamic metal-to-metal seal 108 occurs at the junction or bend between lower cylindrical portion 126 and upper frusto-conical portion 128.

Upper static metal-to-metal sealing ridge 104 is located at the juncture between the upper inner annular corner 124 of body 102 and the lower cylindrical portion 126 of dynamic metal-to-metal seal 108. This location of ridge 104 stabilizes annular body 102 on wall 46 and also provides an annular bearing point for the proper deformation of dynamic metal-to-metal seal 108.

Metal-to-metal seal ring 100 further includes an elastomeric seal 110 disposed in an annular groove or channel 131 located in the outer diameter of annular body 102. Elastomeric seal 110 provides an initial seal of seal ring 100 with outer casing hanger assembly 12 until dynamic metal-to-metal seal 108 is deflected or deformed into metal-to-metal sealing engagement with wall 24 of casing hanger assembly 12. Further, elastomeric seal 110 provides a secondary seal for dynamic metal-to-metal seal 108.

Seal retainer ring 120 includes internal threads 132 which threadingly engage external threads 134 on the lower end of wall 46 above shoulder 52 on tubing hanger assembly 10. A tapped bore 136 is provided in retainer ring 120 to receive a set screw 138 which fixes retainer ring 120 in position upon the assembly of tubing hanger seal assembly 50 onto tubing hanger body 34. Seal retainer ring 120 further includes an upwardly facing bearing shoulder 140 which bears against the downwardly facing lower annular end of annular body 102. Bearing surface 142 also provides a lower stop for metal-to-metal seal ring 100 thereby fixing the relative position of annular body 102 on the wall 46 of tubing hanger body 34 with respect to downwardly facing stop shoulder 56.

Referring now to FIGS. 3–6, upper and lower spacer rings 70, 90 with wedge segments 80 disposed therebetween form an actuation means for actuating dynamic metal-to-metal seal 108 into sealing engagement with annular wall 24 of casing hanger assembly 12. Upper spacer ring 70 abuts the downwardly facing lower stop shoulder 56 of load/landing ring 60 and includes a lower, downwardly facing camming shoulder 72 which is tapered upwardly and outwardly for camming engagement with wedge segments 80 as hereinafter described.

Figure 5:
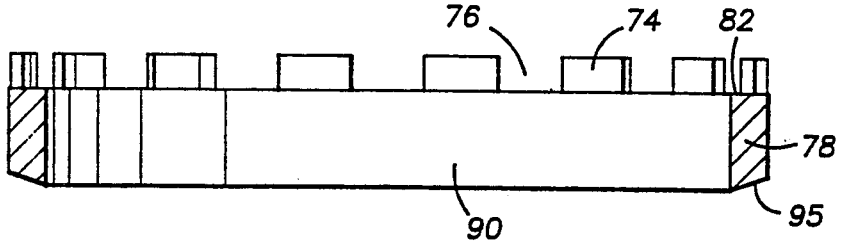
FIG. 5 is a cross-sectional view of the lower spacer ring of the metal-to-metal seal assembly of FIG. 2.

Lower spacer ring 90 includes a castellated upper end, best shown in FIG. 5, forming a plurality of arcuate spacers 74 which form a plurality of arcuate slots 76 therebetween. Arcuate spacers 74 have a common outer diameter with that of the base 78 of lower spacer ring 90 and an enlarged inner diameter forming an upwardly facing support shoulder 82. The downwardly facing lower annular end 95 of lower spacer ring 90 is tapered upwardly and outwardly for engagement with dynamic metal-to-metal seal 108.

Figure 6:
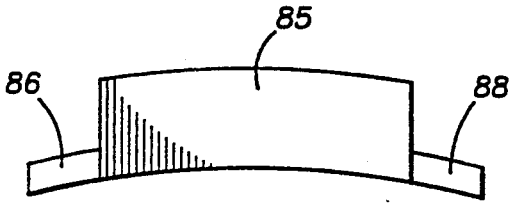
FIG. 6 is a top view of the wedge segment disposed on the lower spacer ring shown in FIG. 5.

Wedge segments 80 include an upwardly facing and an upwardly and outwardly tapering frusto-conical surface 84 adapted for camming engagement with downwardly facing camming shoulder 72 of upper spacer ring 70. As best shown in FIG. 6, arcuate segments 80 include laterally projecting ears 86, 88. The body of wedge segments 80 having a lateral dimension sized to be received within slots 76 of castellated lower spacer ring 90. The outer arcuate face 85 of wedge segments 80 forms a downwardly facing and upwardly and outwardly tapered camming surface which matingly engages the upwardly facing frusto-conical camming shoulder 28 on casing hanger assembly 12.

Upper and lower spacer rings 70, 90, together with wedge segments 80, provide means for actuating the dynamic metal-to-metal seal 108. Wedge segments 80 are cammed radially inward by camming shoulder 28 of casing hanger assembly 12 as arcuate face 85 of wedge segments 80 move downward within bore 20. The downwardly facing camming shoulder 72 of upper spacer ring 70 matingly engages with upwardly facing frusto-conical surface 84 of wedge segments 80. This camming action causes the lower annular end 95 of each of the wedge segments 80 to move downwardly and bear against the upwardly facing support shoulder 82 of lower spacer ring 90 thereby forcing lower spacing ring 90 downwardly into engagement with dynamic metal-to-metal seal ring 108 as shown in FIG. 4.

Upon assembly of the tubing hanger assembly 10 at the factory, upper spacer ring 70 is received over annular wall 46 of tubing hanger body 34 until the upper end of spacer ring 70 engages the annular stop shoulder 56 of load/landing ring 60. Castellated lower spacer ring 90 with wedge segments 80 inserted into arcuate slots 76, is then received over annular wall 46. Wedge segments 80 are maintained in their outermost expanded position such that ears 86, 88 engage adjacent arcuate spacers 74 on lower spacer ring 90. This causes the downwardly facing arcuate face 85 of wedge segment 80 to be projecting beyond the outer diameter of spacer rings 70, 90. In this position, spacer rings 70, 90 are a shorter vertical distance apart than in the actuated position shown in FIG. 4.

Metal-to-metal seal ring 100 is then installed onto tubing hanger body 34. Because static metal-to-metal seal 105 interferingly engages with outer wall 46 of tubing hanger body 34, it is necessary to apply an annular bearing pressure against the lower annular bearing surface 142 of seal ring 100 to force metal-to-metal seal ring 100 over annular wall 46. One method includes threading retainer ring 120 onto threads 134 to force seal ring 100 upwardly into position. Thus, upon the initial assembly of tubing hanger assembly 10, the static metal-to-metal seal 105 of metal-to-metal seal ring 100 is in its sealing position, i.e. in metal-to-metal sealing engagement with annular wall 46. Set screw 138 is also engaged upon the final positioning of seal ring 100.

Once in sealing position such that seal ridges 104, 106 straddle hydraulic test port 112, static metal-to-metal seal 105 may be tested by applying hydraulic pressure through bores 114, 116 and test port 112. If leaks are detected, seal assembly 50 is replaced.

Upon lowering tubing hanger assembly 10 with a suspended string of tubing threaded to bores 36, 38, the tubing hanger assembly 10 is lowered into the profile 18 of outer casing assembly 12. Upon wedge segments 80 entering bore 20 and engaging upwardly facing frusto-conical camming shoulder 28 of outer casing assembly 12, the arcuate face 85 of wedge segments 80 cams segments 80 radially inward. This inward movement causes upwardly facing frusto-conical surface 84 on wedge segments 80 to cam on downwardly facing camming shoulder 72 of upper spacer ring 70. This camming action causes the lower end of wedge segments 80 to move downward and bear against upper bearing surface 82 of lower spacer ring 90 thereby forcing lower spacer ring 90 downward within annular space 54. This downward movement of lower spacer ring 90 causes the downwardly facing lower annular end 95 of lower spacer ring 90 to deform dynamic metal-to-metal seal 108 by causing upper frusto-conical portion 128 to bend at the juncture of cylindrical portion 126 and upper frusto-conical portion 128. Since the length of upper frusto-conical portion 128 is greater than the distance of annular space 54, the sealing lip 130 is coined into the wall 24 of casing hanger assembly 12. This coining establishes a metal-to-metal seal with casing hanger assembly 12.

Figure 8:
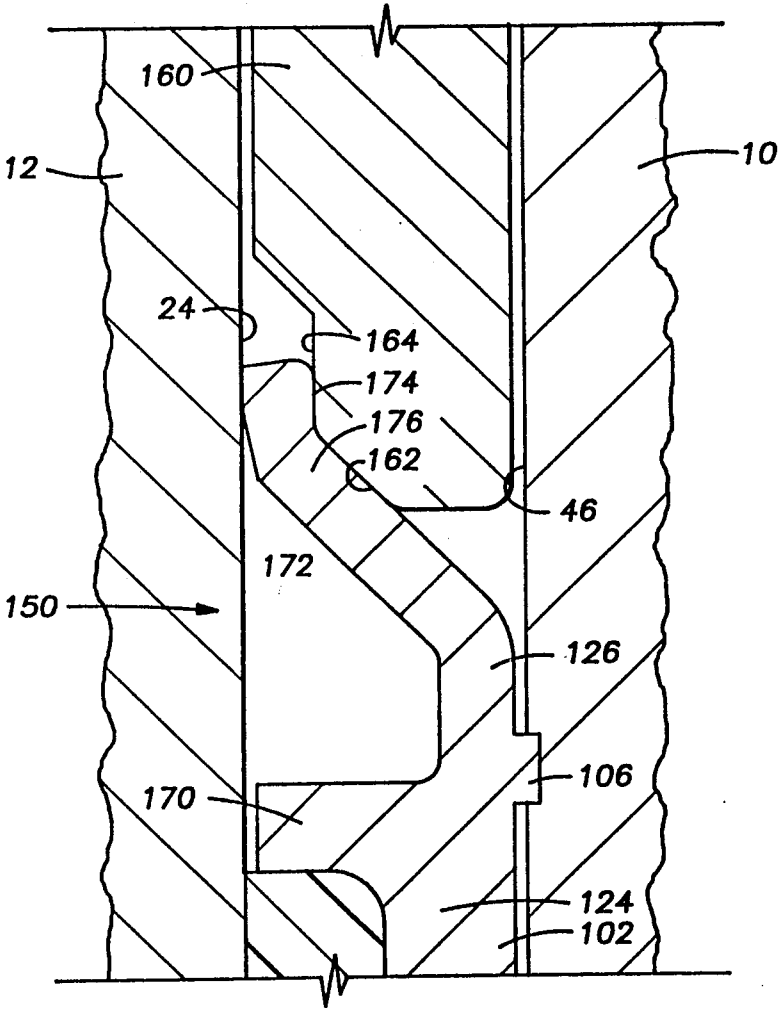
FIG. 8 is an enlarged cross-sectional view of the alternative metal-to-metal seal assembly of FIG. 7 in the actuated position.
Figure 7:
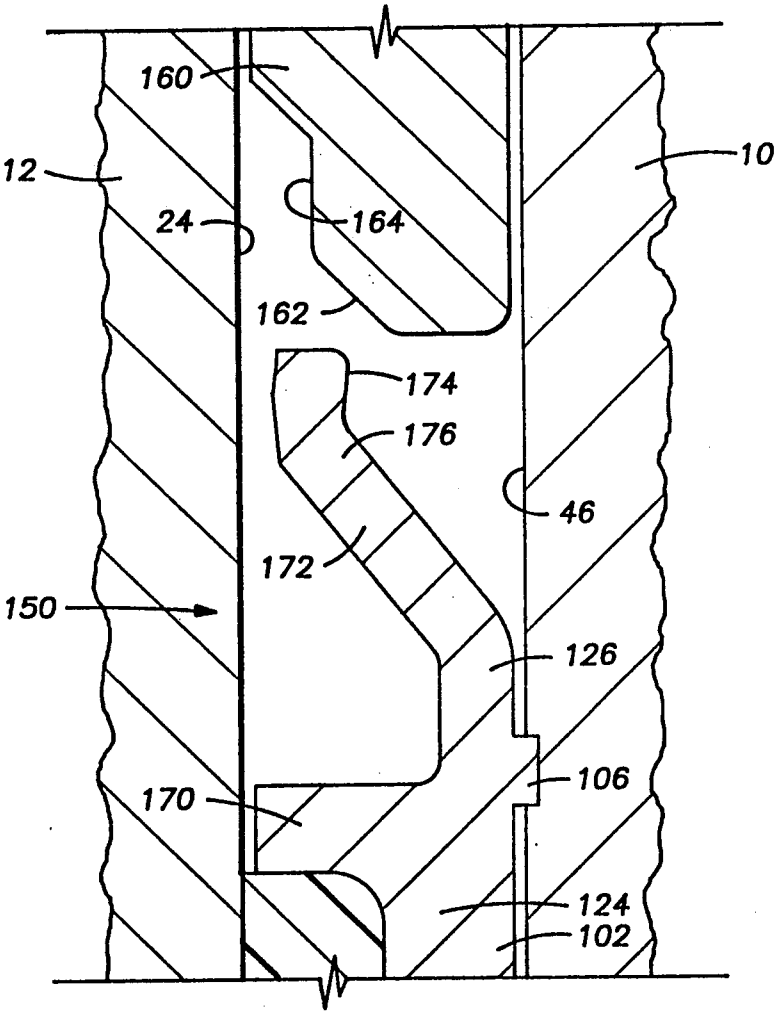
FIG. 7 is an enlarged cross-sectional view of an alternative embodiment of the metal-to-metal seal assembly of FIG. 3 in a non-actuated position.

Referring now to FIGS. 7 and 8, there is shown an alternative embodiment of the metal-to-metal seal assembly of the present invention. Alternative metal-to-metal seal assembly 150 is the same as the preferred metal-to-metal seal assembly 50 with the exception of certain changes to dynamic metal-to-metal seal 108 and lower spacer ring 90. Throughout FIGS. 7 and 8, wherever possible, like or similar numerals are referred to like or similar parts of the preferred embodiment.

Alternative metal-to-metal seal assembly 150 includes upper spacer ring 70, wedge segments 80, a lower spacing ring 160, a metal-to-metal seal ring 170, an elastomeric secondary seal 110, and seal retainer ring 120. Metal-to-metal seal ring 170 includes a static metal-to-metal seal 105 for sealing with the surface of annular wall 46 of tubing hanger assembly 10 and a dynamic metal-to-metal seal 172 for sealing with the annular wall 24 of outer casing hanger assembly 12. Dynamic metal-to-metal seal 172 includes an annular lip 174 which extends outward from the exterior of annular body 102 and then curves to a generally axial upward position. Dynamic metal-to-metal seal 172 is an integral extension of the upper inner annular corner 124 of body 102. The annular extension includes a lower cylindrical portion 126 and an upper frusto-conical portion 176 having annular seal lip 174 at its terminal end. In the running position, the outer diameter of lip 174 is smaller than the inner diameter of outer casing hanger wall 24.

Lower spacer ring 160 is identical to lower spacer ring 90 of the preferred embodiment with the exception of its downwardly facing lower annular surface. Lower spacer ring 160 includes a lower tapered surface 162 which engages the inner surface of upper lip 174 during the setting operation. This engagement moves lip 174 radially outward to the set position in a metal-to-metal sealing engagement with the interior annular wall 24 of outer casing hanger assembly 12. Lower spacer ring 160 is made of a high yield strength steel and dynamic metal-to-metal seal 172 is made of a lower yield strength steel. This allows lip 174 to have sufficient give when forced against the interior of interior wall 24 of casing hanger assembly 12 to flow into the flaws and irregularities of the surface and ensure that a complete metal-to-metal seal is achieved. The high yield strength lower spacer ring 160 is subjected to a slight inward bend at its extremity as shown in FIG. 8. This effectively stores the setting forces to ensure continued sealing of lip 174 against annular wall 24 of casing hanger assembly 12.

With the configuration of the wedging ends of lower spacer ring 160, the forces exerted on sealing lip 174 are exerted by the axially extending surface 164. This causes only radial forces to be exerted on lip 174 so that there is no axial force tending to urge the spacer ring 160 axially away from the sealing lip 174.

While a preferred embodiment of the invention has been shown and described, modifications thereof can be made by one skilled in the art without departing from the spirit of the invention.

What is claimed is:

1. A seal assembly for a hanger suspending a string of pipe into a well from an outer hanger, comprising:

a metal seal ring mounted on and extending around the hanger, said metal seal ring forming a static metal-to-metal seal with the hanger, said static metal-to-metal seal being formed by mounting the seal ring on the hanger;

a dynamic metal sealing lip on said metal seal ring and having a non-sealing position and a sealing position, said static metal-to-metal seal forming a metal-to-metal seal with the hanger in said non-sealing position, said dynamic metal sealing lip adapted to establish a metal-to-metal seal with the outer hanger in said sealing position; and means for moving said dynamic metal sealing lip from said non-sealing position to said sealing position.

2. The seal assembly of claim 1 further including an elastomeric seal mounted on said metal seal ring for sealingly engaging the outer hanger.

3. The seal assembly of claim 2 wherein said metal seal ring includes a groove for receiving said elastomeric seal.

4. The seal assembly of claim 1 wherein said static metal-to-metal seal includes at least one annular projecting rib adapted to be coined into the hanger in said non-sealing position.

5. The seal assembly of claim 1 wherein said dynamic metal sealing lip comprises a frustoconical metal ring integral with said metal seal ring, said frustoconical ring being deformable into metal-to-metal sealing engagement with the outer hanger.

6. The seal assembly of claim 1 wherein said means for moving includes at least one member adapted for camming engagement with the outer hanger whereby upon engagement of the outer hanger, said member moves said dynamic metal sealing lip into said sealing position.

7. The seal assembly of claim 6 wherein said member includes a camming surface adapted for engagement with the outer hanger.

8. A seal assembly for a hanger suspending a strip of pipe into a well from an outer hanger, comprising:

a metal seal ring extending around the hanger, said metal seal ring forming a static metal-to-metal seal with the hanger;

said metal seal ring having a dynamic metal sealing lip with a non-sealing position and a sealing position, said dynamic metal sealing lip adapted to establish a metal-to-metal seal with the outer hanger in said sealing position; and means for moving said dynamic metal sealing lip from said non-sealing position to said sealing position, said means for moving including at least one member adapted for engagement with the outer hanger, said member including a camming surface adapted for engagement with the outer hanger, and said means for moving further including a first tapered surface cammingly engaging a second tapered surface on said member, whereby upon said camming surface engaging the outer hanger, said member moves inwardly and downwardly on said tapered surfaces causing said dynamic metal sealing lip to seal with the outer hanger.

9. The seal assembly of claim 1 further including retainer means for maintaining said static metal-to-metal seal in a static position on the hanger.

10. A tubing hanger for suspending tubing within an outer casing hanger, comprising:

an annular metal body adapted for connection to a string of tubing and having an annular outer diameter metal wall;

a downwardly facing, inwardly and downwardly tapering frusto-conical shoulder disposed around said wall;

an annular spacer member disposed around said wall below said shoulder and supporting a plurality of wedge segments;

said wedge segments having an upwardly facing, outwardly and upwardly tapering frusto-conical surface matingly engaging said downwardly facing shoulder and an outer downwardly and inwardly tapering camming surface adapted for engagement with the outer casing hanger;

an annular metal seal ring extending around said body below said annular spacer member, said seal ring having an inner static metal rim and an outer dynamic metal lip, said lip engaging said annular spacer member;

said inner static metal rim establishing an interference fit with said wall and thereby providing a metal-to-metal seal between said seal ring and said body;

a retainer disposed below said metal seal ring and affixed to said body, said retainer maintaining said inner static metal rim in place;

said dynamic metal sealing lip having an undeflected position where no sealing contact is made with the outer casing hanger and a deflected position where said dynamic sealing lip is coined into the outer casing hanger to form a metal-to-metal seal;

said annular spacer member having an upper non-actuated position where said wedge segments project outwardly of said body for engagement with the outer casing hanger and a lower actuated position where said wedge segments are cammed inwardly by engagement with the outer casing hanger and downwardly by said surface engaging said shoulder;

said annular spacer member moving downwardly against said dynamic metal sealing lip in said lower actuated position thereby deflecting said lip to the deflected position for sealing engagement with the outer casing hanger.

11. The tubing hanger of claim 10 further including port means in said body for applying hydraulic pressure to said static metal rim for testing the metal-to-metal seal.

12. The tubing hanger of claim 10 further including an elastomeric seal mounted on said metal seal ring.

13. The seal assembly of claim 1 wherein the dynamic sealing lip is frustoconical and has a radial width greater than the radial distance between the hanger and the outer hanger.

14. The seal assembly of claim 1 wherein said moving means comprises upper and lower annular spacer rings with a plurality of arcuate wedge segments disposed therebetween, said wedge segments adapted for camming engagement with both the upper spacer ring and the outer hanger, whereby advancing the upper spacer ring increases the distance between the upper and lower rings and causes the dynamic metal sealing lip to move into its sealed position.

15. A tubing hanger for suspending a string of pipe into a well from an outer hanger, comprising:

a hanger;

a metal ring mounted on and coined into the hanger so as to be in metal-to-metal sealing engagement therewith, said ring having an integral frustoconical lip with a width greater than the radial distance between the hanger and the outer hanger, said lip being adapted to be deformed into annular sealing engagement with the outer hanger; and means for deforming said frustoconical lip into sealing engagement with the outer hanger.

* * * * *